United States Patent [19]

Colgate

[11] 4,451,201

[45] May 29, 1984

[54] GAS TURBINE

[75] Inventor: Stirling A. Colgate, Los Alamos, N. Mex.

[73] Assignee: Colgate Research & Development Co., Princeton, N.J.

[21] Appl. No.: 302,255

[22] Filed: Sep. 14, 1981

[51] Int. Cl.[3] ..... F01D 1/02

[52] U.S. Cl. ..... 415/181; 415/205

[58] Field of Search ..... 415/53 T, 71, 101, 181, 415/198.2, 202, 213 T, 90, 92, DIG. 1; 416/4

[56] References Cited

U.S. PATENT DOCUMENTS

| | | | |
|---|---|---|---|
| 3,325,089 | 6/1967 | Vogler | 415/DIG. 1 |
| 3,446,149 | 5/1969 | Amos et al. | 416/4 X |
| 3,973,865 | 8/1976 | Mugele | 415/53 T |
| 4,190,399 | 2/1980 | Amminger | 415/53 T X |

FOREIGN PATENT DOCUMENTS

| | | | |
|---|---|---|---|
| 1108374 | 6/1961 | Fed. Rep. of Germany | 415/DIG. 1 |
| 461364 | 8/1913 | France | 415/202 |
| 1219994 | 1/1971 | United Kingdom | 415/101 |

*Primary Examiner*—Philip R. Coe
*Assistant Examiner*—Frankie L. Stinson
*Attorney, Agent, or Firm*—Brumbaugh, Graves, Donohue & Raymond

[57] ABSTRACT

A gas turbine comprises a specially fluted rotor that induces a set of co-rotating axial vortices within the average circumferential flow. In an expansion turbine these vortices transfer angular momentum and torque to the fluted rotor. One advantage is a rotational tip speed of the rotor slower than conventional turbines and hence reduced tip stress. In a compressor the rotor imparts kinetic energy to the gas.

4 Claims, 6 Drawing Figures

GAS TURBINE

BACKGROUND OF THE INVENTION

The Rankine Vortex is a well known phenomenon in fluid flow. The fluid receives a constant angular momentum from an external source relative to an arbitrary axis. Then fluid is withdrawn along the axis at a radius smaller than the angular momentum injection radius. A vortex or rotating fluid element is formed. If the boundary values are approximately non-dissipative (i.e., frictionless) then necessarily angular momentum is conserved. Since conservation of angular momentum per unit mass requires that the velocity be inversely proportional to the radius, the velocity of the fluid will become larger at smaller radius. In this sense the vortex "winds up" at the axis. If the fluid is incompressible, the ratio of the velocity near the axis to the velocity at the injection radius can be very large. When the fluid is compressible, a turbulent core is formed at an arbitrary radius, but smaller than the injection radius. The turbulent core limits the velocity ratio of the vortex. The treatment of vortex flows in the classic text, *Hydrodynamics* by H. Lamb, Dover Press, 1932, is extensive and thorough.

The most familiar examples of vortex flows are the spiral motion vortices of water draining from a sink or bath tub or, more dramatically, of water spouts and tornadoes. In the latter examples of vortices in the atmosphere, the central core is turbulent. Because it is turbulent, it acts like a rigid wheel and rotates at constant angular velocity; hence the actual velocity decreases with radius inside the core. The size of the core depends upon the angular momentum input at the outer boundary radius and the suction or pressure difference at the axis. The core radius is then that radius such that a laminar angular momentum-conserving flow starting at the outer boundary leads to an integral centrifugal pressure drop equal to the suction.

The Ranque or Hilsch Tube

The laboratory analogue of the large scale atmospheric vortices is the Ranque or Hilsche Tube. A drawing of a Hilsch Tube is shown in FIG. 1. Air from a compressed air source enters tangentially through a nozzle 1 into a cylindrical tube 2. A vortex 3 is formed on the inside of the cylindrical tube and extends the full length of the tube, which may be several to 10 diameters in length. At either end of the tube are exit ports, a central hole at the axis 4 and a peripheral port 5 at the outside radius. These ports are shown in the drawing at opposite ends of the tube. For the best operation of the tube, the tangential entrance nozzle should be closer to the axial port 4 but the action of the Hilsch Tube is not critically dependent upon the relative location of the ports. The surprising result is that the exit stream of air at the peripheral port 5 will be hot and the exit stream from the axial port 4 will be cold. Despite many published papers, there is no agreed theory that predicts with certainty which stream is hot and which one is cold; that is, the Hilsch Tube is not understood in the published literature.

Because the present invention is predicated upon an understanding of the way in which the Hilsch Tube works and utilizes that understanding to make a cheap, efficient turbine with few parts and less critical construction, compared to the multi-blade turbine, the operation of the Hilsch Tube is explained immediately below.

The Hilsch Tube does not violate any law of thermodynamics; it simply takes the energy of the input compressed air and uses it to run a refrigerator (i.e. a heat pump) to produce heat and cold, albeit one that is not too efficient. The Reynolds number of the gas flow is very large, $10^5$ to $10^6$ for laboratory models, and the heating and cooling effect, i.e., efficiency as a heat pump, is small (20%) and is essentially independent of scale. This latter result ensures that the heat pump effect is not dependent upon boundary layer phenomena because the boundary layer is a surface phenomena and hence the efficiency would depend upon a surface to volume ratio and therefore would be dependent upon scale. (A boundary layer of a gas moving across a surface depends only upon velocity and viscosity; a boundary layer effect would depend upon surface area, not volume.)

How the Hilsch Tube Works

The Hilsch Tube works by causing the flow to break up into several co-rotating vortices, each of a diameter of about R/2 where R is the radius of the tube. These co-rotating vortices occur because there is no stable laminar flow pattern that would allow the flow to get out the axial hole at a small radius, i.e. R/3. A parcel of air leaving at the axial port at small radius must find a way to lose some angular momentum; otherwise, it would have to rotate at too high a velocity. Too high a velocity in this case would be, say, three times the injection velocity. Why three times the injection velocity is too high for stable flow is explained below. For laminar flow and constant angular momentum this velocity ratio would occur at a radius determined by $V(r)=V_o(r/R)$ where $V_o$ is the velocity at the entrance to the tube from the nozzle 1. Then $V=3V_o$ when $r=R/3$, or an exit port $\frac{1}{3}$ the radius of the tube.

Assume now that the gas enters the tube tangentially from the nozzle at a velocity of approximately the sound speed ($C_s$) in the original compressed gas. This is a reasonable exit velocity from a nozzle with a pressure ratio of 2.5:1. An expansion of 2.5:1 releases a fraction of the thermal energy of $$1-\left(\frac{1}{2.5}\right)^{\frac{\gamma-1}{\gamma}} \cong 23\%$$

A kinetic energy of $C_s^2/2$ = a fraction of the internal energy of $\gamma(\gamma-1)/2=28\%$ for air where $\gamma$ (the ratio of the molar heat capacity at constant pressure to the molar heat capacity at constant volume) = 1.4. $C_s=(\gamma P/\rho)^{\frac{1}{2}}$, where P is the nozzle supply pressure and $\rho$ is the fluid density at that pressure. A gas expanding through a nozzle converts a fraction of its internal energy to kinetic energy by adiabatic expansion. One can assume, for example, an expansion volume ratio of $(Vol_o/Vol_1)=R_v$ or a pressure ratio of $(R_v)^\gamma=(1.92)^\gamma=2.5:1$. This converts a fraction $(E/E_o)$ of the initial specific internal energy $E_o$ to kinetic energy. $E_o=P_o/[(\gamma-1)\rho_o]$. $P_o$ = initial pressure. $\rho_o$ = initial density. This fraction is $E/E_o=[1-R_v^{(1-\gamma)}]=23\%$. The definition of sound speech is $$C_s = \sqrt{\gamma P_o/\rho_o} = \sqrt{\gamma(\gamma - 1)E_o}\ .$$

Therefore, the kinetic energy of the gas moving at the original sound speed is $c_s^2/2=\gamma(\gamma-1)E_o/2=28\%$. Therefore, the expansion ratio of 1.92:1 will give a nozzle velocity of $0.9C_s$. This is also Mach=1.00 since the internal temperature is reduced by $E/E_o=0.77$.

Assume now a supply of compressed gas at 70 PSI (corresponding to about 5 atmospheres) and that the gas from the exit of the input nozzle is at 2.0 atmospheres (28 PSI) of pressure. This is 1 atmosphere above the exit pressure of 1 atmosphere. Then, if the same gas were to exit through the axial port at a radius of R/3 at constant angular momentum, it would rotate at a velocity three times the input velocity or an exit velocity of 2.7 $C_s$. It cannot reach this velocity by expanding from 2 atmospheres to 1 atmosphere pressure. (A velocity of 2.7 $C_s$ is 9 times the nozzle kinetic energy, or 2.0 times the initial total internal energy available and 14 times the energy available expanding from 2 atmospheres to 1 atmosphere.) Therefore, the air would be trapped in the tube, raising the nozzle exit pressure until velocities were lower and pressures greater.

There is another way for the gas to escape through the axial hole at a lower pressure. That way is by the formation of secondary vortices co-rotating with the primary vortex. These secondary vortices act like paddle wheels. FIGS. 2 and 3 show the secondary vortices 6 and the analogue rotating paddle wheel 7.

In this example the secondary vortices, or paddle wheels, have an outside radius $r_{paddle}=(\frac{3}{4}R)$. Free rotation of the paddle wheel corresponds to a velocity at the paddle radius of $r_{paddle}=V_oR/(0.75R)=1.33\ V_o$, or 1.33 $C_s$. This is a reasonable gas velocity for a pressure ratio of 5:1. Now once the gas contacts the paddles, it co-rotates with the paddles, and hence as it is driven to smaller radius, it must slow down in velocity proportional to r. This is the analogue of the turbulent core or rigid body wheel rotation of the core. The gas arrives at the axis with near zero tangential velocity, hence small angular momentum and hence no significant centrifugal force and no impediment to flow. In the process the gas has given up angular momentum to, and done work upon, the paddle wheels. Hence the paddle wheels will spin faster unless they do work on an external circuit via a shaft or equivalent.

In a Hilsch Tube there is no external circuit, and the work must be dissipated within the gas of the tube. It does so by "beating up", increasing the velocity of and heating the gas near the periphery at the opposite end. Thence comes the hot air discharge from the peripheral outlet. If the paddle wheel were connected to a shaft which in turn did external useful work, this would then be a turbine which is the subject of this invention.

In the Hilsch Tube there is, of course, no paddle wheel. The secondary vortices of unstable flow serve as the blades of a paddle wheel, although as rather poor blades, that make a dissipative contact with the gas rather than a smooth contact as would an ideal paddle wheel. The multiple co-rotating vortices in an unstable vortex have been seen in several tornadoes, and the break-up into discrete vortices has been observed.

The Paddle Wheel

The simplest paddle wheel is a wheel with straight radial vanes (see FIG. 3). This is nearly the design of an engine supercharger exhaust turbine. Indeed these straight vane turbines work very well with the one draw-back that the tangential velocity of the periphery of the turbine wheel must be approximately the speed of sound in the original exhaust gas in order that most of the energy of the exhaust gas be given to the turbine wheel. This results in high blade tip stresses and high rotor velocities.

SUMMARY OF THE INVENTION

The invention is a very simple, low-cost turbine that utilizes a fluted rotor having fluted contours that match the shapes of symmetrical co-rotating secondary axial vortices generated by, in the case of an expansion turbine, injecting a gas at high velocity, preferably near sound speed, from a pressure source tangentially into a cylindrical rotor chamber through one or more nozzles and exhausting the gas through a port some distance inwardly from the perimeter of the chamber and proximate the roots of the flutes. In the case of a compressor turbine, the rotor is driven and genertes the set of symmetrical co-rotating axial vortices. The vortices impart kinetic energy to the rotor to drive it (expansion turbine) or receive kinetic energy from the rotor (compressor turbine). Since the contour of the flutes matches the contours of the secondary vortices, the flutes will induce just such vortices, provided the flutes co-rotate with the axes of these secondary vortices.

The turbine can be used as an expander or compressor stage by itself or with a conventional multi-vane turbine, as a heat engine, or with a positive displacement engine as a supercharger.

For example, suppose the gas is discharged from a nozzle at 0.9 $C_s$. Then a fraction $\gamma(\gamma-1)=0.23$ of the internal energy has been converted to kinetic energy of gas motion. If the secondary vortices are tangent to the flow at $r_{tang}=(\frac{2}{3})R$, then the tangential velocity at this radius for conserved angular momentum will be $$(0.9)\ C_s\ R/r_{tang}=1.35\ C_s$$

so that $(\gamma(\gamma-1)/2)(1.35)^2=51\%$ of the original internal energy is converted to kinetic energy. If $R/r_{tang}=1.89$, 100% of the internal energy would be converted to kinetic, but some residual internal energy is required, especially if the turbine exhausts to the atmosphere. The present example of 51% requires a pressure ratio of $$(1 - .51)\frac{-\gamma}{\gamma - 1} = 12 \text{ fold,}$$

or 12 atmospheres of inlet pressure if the turbine exhausts to the atmosphere. Thus the radius at which the secondary vortices will match the flow will be between $1 \leqq R/r_{tang} \leqq 1.89$. A ratio of $r/R=\frac{2}{3}$ has now been supposed for the example corresponding to a pressure ratio of 12:1. Next a radius is chosen for the root or circle of solid core of the rotor ($r_{rotor}$). This should be small enough such that between the root radius and an axial port radius there is sufficient area for the gas to escape axially. If the root radius $r_{root}=R/6$ and the exit port $r_{exit}=R/4$ then the exit port extends well outside the root. The secondary vortices, therefore, must extend from R/6 to $(\frac{2}{3})R$, or the radius of the secondary vortex is $r_{sec\ v}=[(\frac{2}{3})R-R/6]/2=R/4$. The tips of the flutes, then, extend to the radius of the axis of the secondary vortices or to $r_{sec\ axis}=R/6+R/4=(5/12)R$. The velocity of the flute tips will be smaller by the ratio $r_{sec\ axis}/r_{tang}=(5/12)\ R/(\frac{2}{3})R=\frac{5}{8}$. The stress in a vane of similar shape would be smaller by $(\frac{5}{8})^2=0.39$ which is a substantial amount. In addition the flutes become thicker as they approach the root of the rotor in a fashion that is a more rapid function of radius $$\left(\frac{\Delta W}{W_{min}}\ \alpha r^{-2}\right).$$

Therefore, the tip stress is less for a flute than the usual vane. This reduction in the stress in the rotor tips is roughly two fold and so the stress in the rotor is substantially less (≅20%) of that in a standard turbine blade.

Finally, the number of flutes around the rotor can be calculated. This number is the circumference at the radius of the secondary vortex axes divided by the diameter of the secondary vortices, i.e., $$2\pi r_{sec\ axis}/2r_{sec\ vortices}=\pi(5/12)/(\tfrac{1}{4})\cong 5.$$

The tangential velocity at the port radius of R/4 will be smaller than the tangential velocity at maximum, namely at $r_{tang}=(\frac{2}{3})\ R$ by the ratio $(R/4)/r_{tang}=\frac{3}{8}$. Therefore, the residual kinetic energy of the gas at the exit port radius becomes $(\frac{3}{8})^2=0.14$. This small residual kinetic energy is recoverable by exit port design, resulting in a small underpressure. Therefore, the turbine has extracted the major fraction of the rotational energy of the gas. This rotational energy is that at the tangent radius $((\frac{2}{3})R_o)$ where the flow velocity is $(0.90_s\times 3/2)=1.35\ C_s$, or 51% of the original internal energy. This is also the ideal Carnot efficiency of a gas cycle, $\gamma=1.4$, with a pressure ratio of 12:1 or volume ratio of 5.9:1.

The turbine just described is an expansion turbine. An important advantage is that the tip speed of the rotor is substantially less than a standard blade turbine. In addition the shape of the highest velocity tips is tapered such as to afford reduced stress as well as simple cooling. This means that higher temperature gas can be used, and therefore higher efficiency or cheaper construction is possible. In this sense the expansion turbine is the fundamental limitation in turbine engines.

A Compressor

A compressor, on the other hand, works at roughly ½ the temperature and $1/\sqrt{2}$ the tip speed, or ½ the tip stress. Therefore, the compressor is far less critical in terms of stress and temperature and for a vortex turbine can be of the standard multi-vane type without degrading the advantage of the vortex turbine expansion. On the other hand, the flow through the vortex turbine is entirely reversible, and the vortex turbine can be operated as a compressor as well. The same analyses apply, except the rotor shaft is driven rather than driving an external load, and compressed gas is delivered through the nozzle(s).

The combination of compressor, heat source and expansion turbine is a complex heat engine as in a jet, turboprop or gas turbine engine. On the other hand the compression turbine or expansion turbine can be used separately, such as for an exhaust turbine or as a supercharger for piston engines.

The advantages of a vortex turbine embodying the present invention are (1) simplicity of design and construction, (2) reduced maximum tip velocity for a given initial gas state, and (3) monolithic tapered tip design that substantially reduces the maximum internal stress of the tip and rotor, thus allowing higher speeds or less critical materials for a given speed.

THE EMBODIMENT

Figure 1:
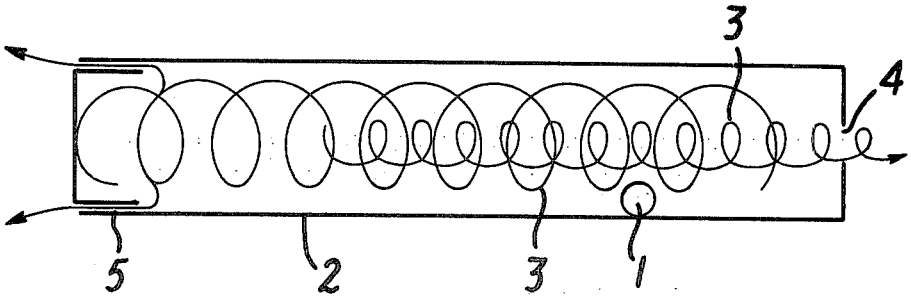
FIG. 1 is a schematic side cross-sectional view of a Hilsch tube.
Figure 2:
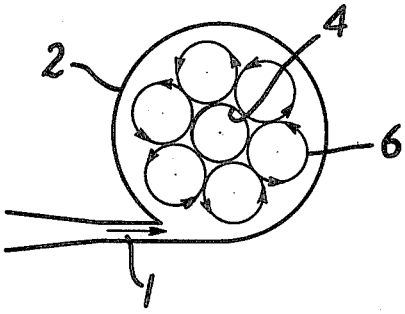
FIG. 2 is a schematic end cross-sectional view of a Hilsch tube, viewed looking toward the end with the central hole.
Figure 3:
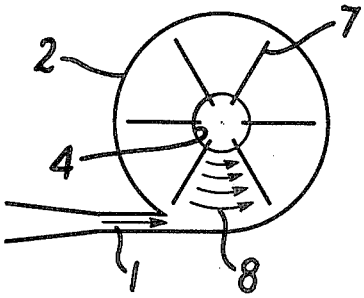
FIG. 3 is a schematic end view of a paddle wheel.
Figure 4:
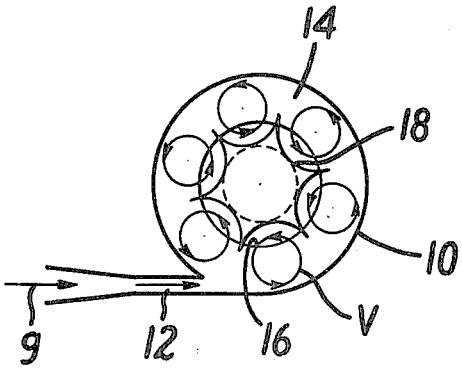
FIG. 4 is a schematic end view of a vortex turbine embodying the present invention.

A vortex compressor-turbine embodying the present invention is an extremely simple machine. It comprises (see FIG. 4) a chamber bounded by a circular cylindrical casing 10 having at least one tangential inlet nozzle 12, a pair of end walls (only one, designated 14, shown), at least one of which has an annular outlet port 16 located concentric to and radially inward from the casing and a fluted rotor 18 journaled in the end walls. In the turbine mode pressurized gas g supplied to the nozzle is induced to form co-rotating vortices V within the total circumferential flow that transfer angular momentum and torque to the rotor.

Figure 5:
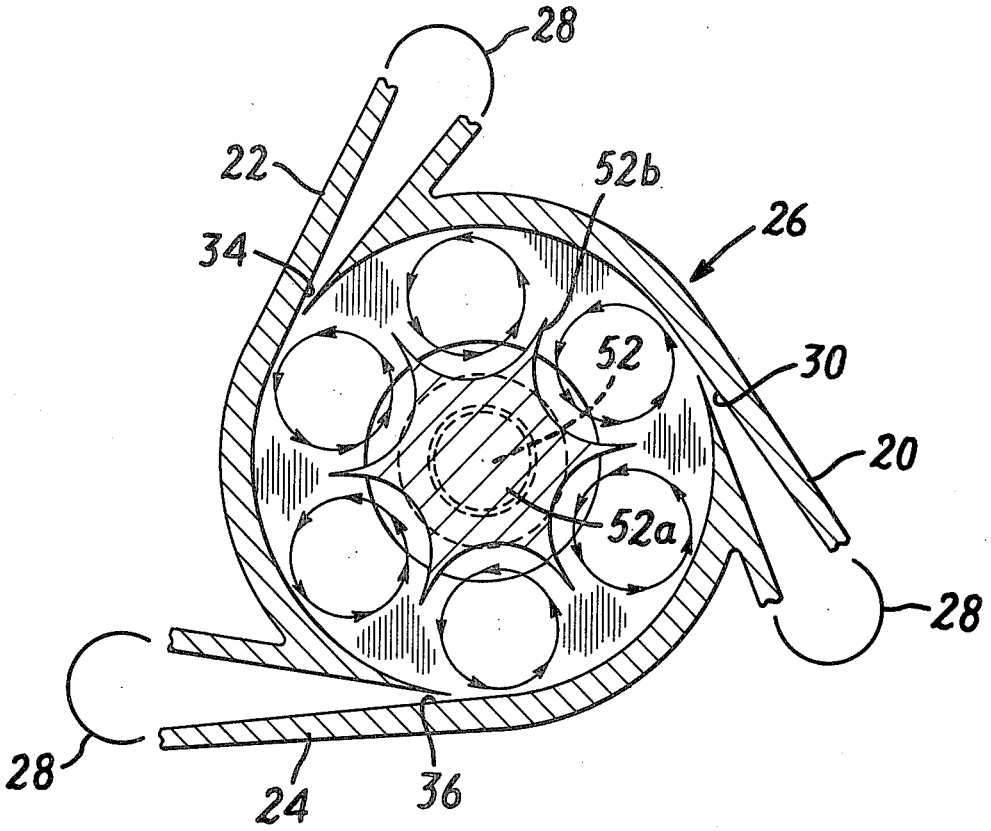
FIG. 5 is an end cross-sectional view of an embodiment of the invention.
Figure 6:
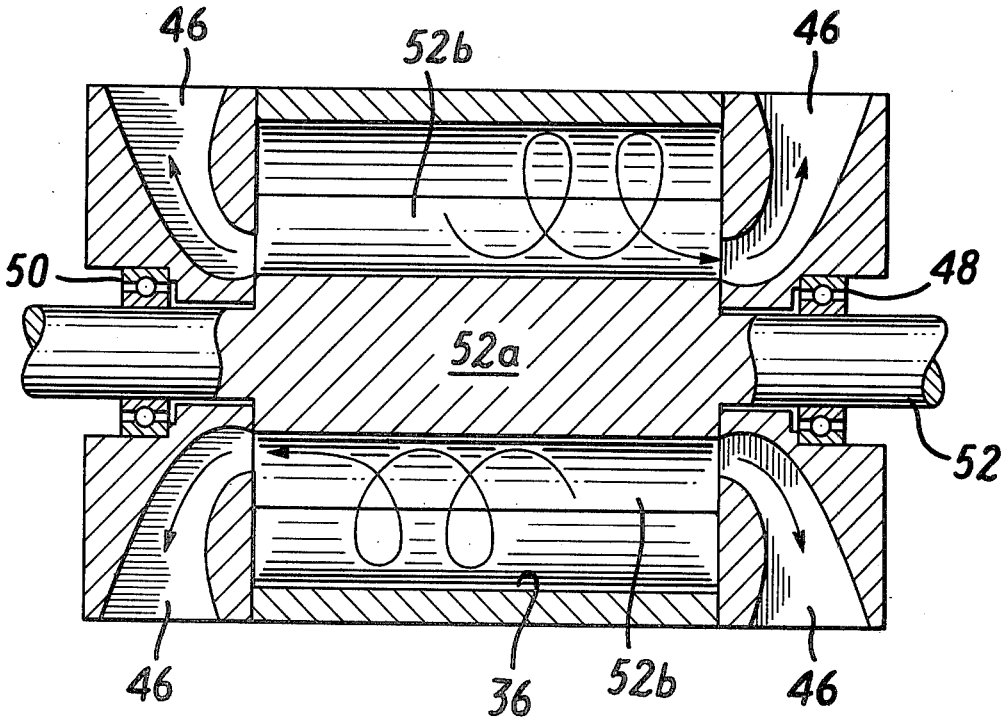
FIG. 6 is a side cross-sectional view of the embodiment shown in FIG. 5 taken generally along the lines 6—6 of FIG. 5 and in the direction of the arrows.

In a slightly more sophisticated version, as shown in FIGS. 5 and 6, three nozzles 20, 22 and 24 spaced 120° apart around the cylindrical casing 26 receive a gas under high pressure from a plenum 28 (shown schematically). The nozzle orifices are thin slots 30, 34 and 36 that extend the full length of the casing and supply the gas tangentially at the circumference of the chamber. Each end plate 38 and 40 has an annular outlet passage 42, 44 and comprises two rings joined by suitably shaped and oriented vanes 46. Bearings 48 and 50 in the end plates support the shaft 52 of a fluted rotor that comprises a root or core **52*a* and several equally circumferentially spaced-apart flutes 52*b*** that, preferably, define segments of concave circular semi-cylindrical surfaces. The vortices formed in the volutes of the rotor transfer torque to the rotor and drive the turbine shaft. After about 1½ revolutions the vortices flow axially along the roots of the flutes and leave the chamber through the outlet ports.

The rotor may have anywhere from 3 to about 12 flutes and a radius at the flute tips of from ⅛ to ½ the radius of the chamber. The tips of the flutes should track the paths of the axes of the vortices (an imaginary cylindrical surface). The nozzles should be designed to inject or receive gas at a velocity in the range of Mach 0.5 to Mach 1.5 and have a throat area (total) that is a small fraction (1/5 to 1/20) of the end port area (effective total) so that the expansion-compression ratio will be of the order of 10. The ratio of length to diameter of the chamber is not critical and can range from 1 to 4 to several to 1.

Some Design Considerations

A practical design is a compromise of the various losses. These losses are:

1. Friction with the end walls.
2. Friction with the peripheral walls.
3. Kinetic energy of azimuthal motion at exit.
4. Kinetic energy of axial flow at exit.
5. Friction of the co-rotating vortices with the rotor and each other.

Conditions 1 and 2 require that the mass and energy flux through the turbine be larger than the friction with the walls. At high Reynold's number the friction with the wall is roughly $\rho U^2/200$ per unit area. The effective area is $\pi R_o^2$ per end, where $R_o$ is the outer wall radius. The gas velocity relative to the walls U of the co-rotating vortices will decrease with the radius roughly as $R/R_o$ as does the wheel rotation flow. In this case $\langle U^2 \rangle \cong \frac{1}{2} U_o^2$, where $U_o$=velocity at $R_o$, so that for the two ends, the end wall friction becomes approximately $2\pi R_o^2 U_o^2 \rho(\frac{1}{2})/200$. The outer cylindrical wall at $R_o$ gives rise to a friction $2\pi R_o L U_o^2 \rho/200$. These values of friction in turn must be compared to the input momentum flux $\phi_o \rho$. In addition, the axial velocity as well as the azimuthal velocity at exit should both be small compared to $U_o$. The azimuthal velocity $U_{az}$, of the co-rotating vortex gas at the radius of the exit port is the difference between the rotor velocity at the exit port radius and vortex velocity relative to the rotor. This difference is just equal to zero for the conditions $R_{center}/R_o = \frac{2}{3}$ corresponding to a vortex radius $r = R_o/3$. $R_{center}$ is the radius of the center of the secondary vortices. Then the momentum flux at the exit is just the axial flow which is $U_o/2$ with an exit area $\pi(R_o/2)^2 - (R_o/3)^2 \cong \pi R_o^2(1/7)$. The effective area of this exit orifice will be that of the exit port $\pi(R_o/2)^2$ partially blocked by the area of the rotor root of radius $R_o/3$. Then the exit flux becomes $\phi_{2exit} = \pi R_o^2 U_o(1/14)$. This requires an input momentum flux equal to $U_o \rho(\phi_{2exit}) = \pi R_o^2 \rho U_o^2/14$. The end friction and the cylindrical wall friction are roughly equal when $L = R_o/2$ (with two ends) in which case the total wall friction becomes $F_r = \rho U_o^2 R_o^2(2\pi/200)(4/9 + \frac{1}{2}) \cong 1/100 \pi R_o^2 \rho U_o^2$. This is a 14% of the above input momentum flux.

Input Nozzles

The input flux enters through an input nozzle or nozzles. The area of this nozzle consists of a maximum length L and minimum port opening R. This is also the thickness of the input flux stream. It could be injected through n nozzles distributed around the circumference and therefore have an opening R/n. The thickness $\Delta R/n$ of the injected streams must be small compared to the radii of the nested vortices. In this design example $$\Delta R = \frac{\phi_{exit}}{2\pi L\ U_o} = \frac{\pi R_o^2 U_o/14}{2\pi L\ U_o}$$

For $L = R_o/2$, then $R = R_o/14$. Since the radius of each vortex is $r = R_o/3$, the input nozzle opening $\Delta R = r/5$, which is a small perturbation of the vortex. It would be somewhat better for n=3 so that the entering flow better matches the vortex velocity distribution. Then $R = R_o/42$.

We therefore end up with the following design:

Vortex radius, $r = R_o 3$

Exit end holes $R_{exit} = R_o/2$

Length $L = R_o/2$

Number of flutes=

$$\frac{2\pi(R_o - r)}{2r} = 2\pi \cong 6$$

Flute tip radius $= R_o - r = \frac{2}{3} R_o$

The losses are:

1. Friction with the stationary walls: This has been calculated above and is $F_r = (1/100)\ \pi R_o^2\ \rho U_o^2$, or 1/7 (input momentum flux) $= 1/7\ (\pi R_o^2\ \rho U_o^2/14)$, or 14% loss.

2. The kinetic energy of the exhaust stream:

The exhaust velocity is $U_{exh} L = U_o/2$ and it is entirely in the axial direction. The fractional kinetic energy of the exhaust stream will then be $(U_{exh}/U_o)^2 = 1.4$. Therefore the exhaust loss will be 25%.

3. Friction of the co-rotating vortices with the rotor:

The velocity of the vortices relative to the rotor is $U_{vortex} = U_o(R_o - R_{center})/R_o = U_o/3$. The area of the rotor is 6 rL; $r = R_o/3$; $L = R_o/2$ so that area $= \pi R_o^2$. The friction is (area)$v^2/200 = \pi R_o^2\ \rho(U_o^2/9)/200$. This is (1/18) (1/100) $\pi R_o^2\ \rho U_o^2$ or 6% of the stationary wall friction of (1) above.

4. The friction between vortices depends upon the fraction of the vortices' are a that is in contact where the flow directions are opposite. One half the vortex path is nested in the rotor, and the friction has already been calculated. Of the remaining half of the vortex revolution, again roughly one half is in contact with the outer wall whose friction has already been calculated. The remaining $\frac{1}{4}$ of the vortex circumference wall generates local eddies nested between in the triangle whose apex is the rotor tip, and whose sides are two co-rotating vortices and the wall. These secondary vortices will have an entrainment of the primary vortices leading to an estimated coefficient of friction of 1/20, or roughly 10 times greater than the smooth wall coefficient of 1/200. Therefore these secondary vortices will give rise to a friction of 10×fractional path length, or $10 \times 174 \times 2 = 5$ times that of the rotor area. The secondary vortices have $\frac{1}{2}$ the area of the rotor. Since the rotor gives rise to 1/18 the fraction of the walls, the intervortex friction should be $\frac{1}{3}$ that of the walls, or the intervortex friction becomes $F_{interv} = (1/300)\ \pi R_o^2\ \rho U_o^2$.

The combined friction losses of the stationary walls (14%), the moving wall (1%), and the intervortex friction (5%) total 20% so that it is worthwhile to make the turbine double ended or twice as long $L = R_o$ with exit ports at either end. This removes one end per section, $L = R_o/2$ long, so this then reduces the friction loss by $\frac{1}{3}$.

Vortex Revolutions

One can calculate the number of revolutions of each vortex within a flute by considering the vortex velocity around their separate centers at $R_{center}$. The center velocity $U_{center} = U_o R_{center}/R_o - (\frac{2}{3}) U_o$. The peripheral velocity relative to this center—or rotor—is $U_o/3$. The mass circulating around each vortex per revolution is $\pi r^2 L$, and the period of a revolution is $2\pi r/(U_o/3)$ or a mass flux $\phi_r$ of rL $\rho U_o/6$. For 6 vortices, $r = R_o/3$, $L = R_o/2$, and thus $\phi_r = R_o^2\ \rho U_o/6$. The number of revolutions then becomes (circulating mass flux)/(input mass flux) $= (R_o^2\ \rho U_o/6)/(\pi R_o^2 U_o\ \rho/14) = 1$. Therefore, the flow in this design makes roughly one vortex-like revolution in each flute before exiting along the axis.

This is a near optimal value because less than a revolution would not be sufficient for the gas to describe a vortex flow and more revolutions would give rise to needless additional friction.

The exhaust stream contains a significant fraction of the useful energy (25%), and so it may be a better compromise to decrease the exit axial velocity from $U_o/2$ to $U_o/3$. The mass flux will be correspondingly reduced so that the friction will be increased from 14% to 22% and the exhaust loss decreases from 25% to 11%. the overall efficiency of this design is (1−0.33) or 67%. This efficiency is lower than well designed multi-section, multi-blade turbines where 80% efficiency is typical. On the other hand construction is greatly simplified, the rotor tip speeds are ⅔ of the input gas velocity, the rotor construction is optimal for minimum tip stress for a given speed, and the tip cooling is feasible.

Gas Conditions

The pressure ratio and input nozzle design for the rotor and housing design that gives rise to the friction losses of the last section can be calculated.

First one must calculate the radial pressure drop for the vortex flow pattern in terms of the input velocity $U_o$ and the density $\rho_o$.

The mean azimuthal velocity U of a parcel of gas as it passes through the co-rotating vortices is a complicated function of radius, but one can approximate this distribution as "wheel rotation" $U=U_o(R/R_o)$ since the net effect of the co-rotating vortices is to reduce the angular momentum of the input stream to near zero at the axis so that the flow can exit at small radius. Then the centrifugal pressure drop becomes $$P_{cent} = \int_{R_o}^{O} (\rho U^2/R)dR = U_o^2/R_o^2 \int_{R_o}^{O} \rho R\, dR.$$

On the other hand $\rho$ will be adiabatically related to P so that one must solve the equation:

$$dP/dR=\rho U^2/R$$

where $\rho=\rho_o (P/P_o)^{1/\gamma}$. Then $$(P/P_o)^{-1/\gamma}d(P/P_o)=(\rho_o/P_o)(U_o^2R_o^{-2})dR.$$

Sound speed at the entrance nozzle $C_o^2=\gamma P_o/\rho_o$, so $$(P/P_o)^{-1/\gamma}\, d(P/P_o)=[\gamma U_o^2R_o^{-2}/C_o2]R\, dR.$$

Integrating both sides:

$$[\gamma/(\gamma-1)]\,(P/P_o)^{(\gamma-1)/\gamma}]_{P_o}^{P_1} = (-\gamma/2)\,(U_o^2R_o^{-2}/C_o^2)R^2]_{R_o}^{R_1}$$

where $P_1$ and $R_1$ are the respective values at the exit radius. Then:

$$P_1/P_o=\{1-(\gamma-1)/2\,(U_o^2/C_o^2)\,[1-(R_1/R_o)^2]\}^{\gamma/(\gamma-1)}.$$

This equation defines a limiting ratio of $U_o/C_o$ in terms of the exhaust radius ratio $R_1/R_o$. For example, if $R_1/R_o=\frac{1}{3}$ so that the azimuthal velocity component is zero at exit, and if $U_o/C_o=1$, the $P_1/P_o=0.495$.

In addition a pressure ratio across the input nozzle necessary to obtain a given Mach number $U_o/C_o$ can be determined. (See Courant and Friedrecks, *Supersonic Flow and Shock Waves,* Interscience Pub., 1963, p. 378.).

If the initial state of the gas before entering the nozzle is defined by U=0, $C=C_{init}$, then the flow in the throat $U_*$ is just sonic and $$U_*=C_*=[2/(\gamma+1)]^{\frac{1}{2}}C_{init}=0.913\ C_{init}$$
$$P_*=P_{init}\,[2/(\gamma+1)^{\gamma/(\gamma-1)}=0.528\ P_{init}$$
$$\rho_*=\rho_{init}\,[\gamma/(\gamma-1)]^{1/(\gamma-1)}=0.634\ \rho_{init}$$

and $$U_o/C_o = \{[(\gamma+1)/(\gamma-1)]\ C^{*2}/C_o^2 - 2/(\gamma-1)\}^{\frac{1}{2}}$$
$$= \{[(\gamma+1)/(\gamma-1)](P^*/P_o)^{(\gamma-1)/\gamma} - 2/\gamma - 1\}^{\frac{1}{2}}$$
$$= \{[(\gamma+1)/(\gamma-1)](P_{init}/P_o)^{(\gamma-1)/\gamma}[2/(\gamma+1)] - [2/(\gamma-1)]\}^{\frac{1}{2}}$$

also $$U_o^2/C_{init}^2=(2U_0^2/C_o^2)/[(U_o^2/C_o^2)(\gamma-1)+2]$$

If one uses $\gamma=1.4$, then $$U_o/C_o=2.236\ [(P_{init}/P_o)^{0.286}-1]^{\frac{1}{2}}$$

or $$P_{init}/P_o=[1+(U_o/C_o)^2/5]^{3.5}$$

For example when $U_o/C_o=1$, $P_{init}/P_o=1.893$. This is just the condition $U_o=C_o=C_*$. Then the overall pressure ratio of the turbine from equation 7 becomes:

$$(P_{init}/P_o)\ (P_o/P_1)=3.82$$

There will be some pressure recovery in the exhaust nozzle.

This velocity for the case $U_{exhaust}=U_o/3$ becomes from equation 12:

$$U_{exh}=U_o/3=(2/3)\ (U_o^2/C_o^2)/[(U_o^2/C_o^2)(\gamma-1)+2]$$

or $$U_{exh}=C_*/3=0.304\ C_{init}$$

for the chosen condition $U_o=C_o=C_*$. Then $$\Delta P_{recovery}=\rho_{exh}\ U_{exh}^2\approx 0.093\gamma P_{init}\ \rho_{exh}/\rho_{init}\approx 0.013\ (T_{init}/T_{exh})$$

The exhaust temperature, $T_{exh}$, will be determined by the turbine input temperature, but the ratio will be that corresponding to roughly the adiabatic ratio or $$(P_{init}/P_{final})^{(\gamma-1/\gamma)}=1.467=T_{init}/T_{final}.$$

Friction will decrease this by roughly 60% so that the temperature ratio should be closer to 1.280 and the recovery pressure $\Delta P_{exh}$ ratio will be $0.13\times1.280=0.166$. Therefore the turbine exit pressure to final exhaust pressure will be $1/(1+\Delta P_{exh})=0.857$ and the total external pressure ratio across the turbine will be $(P_{init}/P_1)/(1+\Delta P_{exh})=3.3$.

The Design Ratio $U_o/C_o$

The advantage of an initial design where the injected gas is just transonic is that the injection nozzle design becomes trivial. This is just the condition that corresponds to the throat of a nozzle when transition from subsonic to supersonic flow takes place. These conditions allow for some mismatch in the flow conditions out of the nozzle into the rotating flow since $C_o=U_o$ and transverse flows can occur without producing strong shocks. For higher pressure ratio turbines, $U_o/C_o$ will have to be increased as determined from equations (7) and (12). For example, if $U_o/C_o=2$, then $P_1/P_o=0.205$ and $P_{init}/P_o=3.24$, or $P_{init}/P_1=15.8$ and the ratio of the input nozzle areas becomes:

$$A/A_*=\{(\gamma+1)/[(\gamma-1)U_o^2/C_o^2+2]\}^{1/(\gamma-1)}\times\{(\gamma+1)U_o^2/C_o^2/[(\gamma-1)U_o^2/C_o^2+2]\}^{1/2}=1.122$$

Thus a very small change in nozzle shape from no divergence to 12% divergence significantly changes the Mach number and pressure ratio of the turbine.

In practice this means that the input nozzle can be designed with a divergence of 12% and the flow will adjust itself from $U_o/C_o=1$ to 1.414 with negligible perturbation and a turbine of a given design can accept a large range of pressure ratios up to threefold.

Efficiency Measurement

For the case when $U_o/C_o=1$, $A=A_*$ and the pressure ratio $P_{init}/P_1=3.82$, one expects $T_{init}/T_{exh}=1.467$ for 100% efficiency or $(T_{init}-T_{exh})=0.467\ T_{init}=140°$ C. if $T_{init}$ is ambient temperature compressed air at 300° K. (22° C.) and an initial pressure of 3.82 (1−0.166) atmospheres=45 PSI. The efficiency will then be $T_{observed}/T_{ideal}$. When the exhaust recovery pressure is included, then the ideal temperature difference is $$T_{ideal}=[(P_{init}/P_{ambient})^{(\gamma-1)}/\gamma-1]T_{init}=0.39\ T_{init}$$

This is equal to 117° K. in the present example.

Turbine Power

An ideal vortex turbine has the characteristics:

$R_o$=radius of chamber.

The turbine is double-ended so that $L_o=R_o$. The nozzle area is such that the combined nozzle exit area is:

$$A_{nozzle}=L\Delta R=0.0476\ R_o^2$$

where $$\Delta R=(\tfrac{2}{3})\ (R_o/14)=0.0476\ R_o$$

(Then the exhaust velocity is $U_o/3$.)

If one chooses the transsonic case where $$U_o=C_o=C_*=0.983\ C_{init}$$

then the pressure ratio is 3.82 at turbine exhaust and 3.2 to atmosphere.

Then supplying compressed air at 3.2 atmospheres pressure and at ambient temperature, the mass flux becomes:

$$\phi=0.0476\ R_o^2C_*\rho_*$$

and the useful power becomes $$W=\phi C_v\ [P_{init}/P_{exh})^{(\gamma-1)}/\gamma-1]/P_{init}\times\text{efficiency}$$

where $C_v$ is the specific heat.

Using the values of $C_v=0.913\ C_{init}$ and $\rho_*=0.634\rho_{init}$ one obtains $$\phi=0.0275\ R_o^2C_{init}\ \rho_{init}\ \text{grams per second.}$$

but $$P_{init}=(P_{init}/P_{amb})\rho_{amb}=3.2\ _{amb},\ C_v=0.25\ \text{joules/cc.}$$

Therefore $W=96\ R_o^2\times$eff watts where $R_o$ is measured in cm. Thus a 10 cm diameter by 5 cm long turbine should deliver 1.4 KW at 60% efficiency for an input pressure of 31 PSI gauge at sea level, standard conditions.

I claim:

1. A gas turbine comprising a chamber defined by a substantially circular cylindrical peripheral surface and spaced-apart end surfaces, said chamber having an axis coincident with the geometric central axis of said circular cylindrical peripheral surface, at least one nozzle opening tangentially to the chamber at the cylindrical surface, a rotor mounted for rotation about the axis of the chamber, the rotor having a multiplicity of equally circumferentially spaced-apart flutes that extend parallel to the axis of the chamber, have interconnected arcuate side surfaces defining a multiplicity of outwardly facing concave substantially semi-cylindrical surfaces on the rotor and have tips spaced-apart radially inwardly from the cylindrical surfaces by a distance substantially equal to the circumferential spacing between the tips of adjacent flutes, and ports in the end surfaces located proximate to the radially innermost portions of the semi-cylindrical surfaces of the rotor, whereby a symmetrical set of multiple axial vortices, each nested between flutes of the rotor, co-rotate with the rotor and drive or are driven by the rotor to supply to or receive from the rotor kinetic energy.

2. A gas turbine according to claim 1 wherein the radius of the cylindrical surfaces of the chamber has a selected value R and the radius of the rotor at the tips of the flutes is from about R/8 to about R/2.

3. A gas turbine according to claim 1 or 2 wherein the tips of the flutes are located substantially at an imaginary circular cylindrical surface defined by the axes of the vortices.

4. A gas turbine according to claim 1 wherein the nozzle or nozzles are sized to inject or receive gas at a velocity of from about Mach 0.5 to about Mach 1.5, and to provide a compression-expansion ratio of the order of 1:10.

* * * * *

UNITED STATES PATENT AND TRADEMARK OFFICE

CERTIFICATE OF CORRECTION

PATENT NO. : 4,451,201

DATED : May 29, 1984

INVENTOR(S) : Stirling A. Colgate

It is certified that error appears in the above-identified patent and that said Letters Patent is hereby corrected as shown below:

First page, item 73, "Colgate Research & Development Co." should read --Colgate Thermodynamics Co.--.

Col. 1, line 44, "Hilsche" should read --Hilsch--.

Col. 2, line 68, "speech" should read --speed--.

Col. 4, line 22, "genertes" should read --generates--.

Col. 7, line 43, "a 14%" should read --14%--.

Col. 8, line 27, "are a" should read --area--.

Col. 8, line 42, "10X174X2" should read --10 x 1/4 x 2--.

Col. 10, line 6, "+1)" should read --+1)]--.

Col. 10, line 17, delete "/".

Col. 11, line 11, ")1/(y)1)" should read -- -1/(y-1)--.

Col. 11, line 12, ")1/2" should read --1/2 --.

Signed and Sealed this

Fourth Day of December 1984

[SEAL]

*Attest:*

*Attesting Officer*

GERALD J. MOSSINGHOFF

*Commissioner of Patents and Trademarks*